US006234747B1

(12) United States Patent
Mielke et al.

(10) Patent No.: US 6,234,747 B1
(45) Date of Patent: May 22, 2001

(54) RUB RESISTANT COMPRESSOR STAGE

(75) Inventors: Mark J. Mielke, Blanchester; Michael D. Carroll, West Chester; Mark W. Marusko, Middletown; James E. Rhoda, Mason; David E. Bulman, Cincinnati, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/439,436

(22) Filed: Nov. 15, 1999

(51) Int. Cl.[7] ..... F01D 5/10
(52) U.S. Cl. ..... 415/119; 415/173.1; 415/914
(58) Field of Search ..... 415/119, 173.1, 415/185, 191, 224, 914; 416/228, 223 A, 500

(56) References Cited

U.S. PATENT DOCUMENTS 4,086,022 4/1978 Freeman et al. ..... 415/119
4,540,335 * 9/1985 Yamaguchi et la. ..... 415/129
5,137,419 8/1992 Waterman ..... 41/170.1
5,707,206 * 1/1998 Goto et al. ..... 415/173.1
5,762,470 * 6/1998 Gelmedov et al. ..... 415/57.4

FOREIGN PATENT DOCUMENTS

2158879 * 11/1985 (GB) .

* cited by examiner

*Primary Examiner*—Edward K. Look
*Assistant Examiner*—Ninh Nguyen
(74) *Attorney, Agent, or Firm*—Andrew C. Hess; Rodney M. Young

(57) ABSTRACT

A compressor casing is configured to surround blade tips in a compressor stage. The casing includes stall grooves with adjoining lands defining respective local gaps with the blade tips. At least one of the lands is offset to locally increase a corresponding one of the gaps larger than the nominal gap for the casing to reduce tip rubbing thereat.

17 Claims, 3 Drawing Sheets

RUB RESISTANT COMPRESSOR STAGE

The U.S. Government may have certain rights in this invention in accordance with Contract No. N00019-96-C-0176 awarded by the Department of the Navy.

BACKGROUND OF THE INVENTION

The present invention relates generally to gas turbine engines, and, more specifically, to compressors therein.

In an aircraft turbofan gas turbine engine, air is compressed in various fan and compressor stages by rotor blades cooperating with stator vanes. Fan air is used for providing propulsion thrust, and compressor air is mixed with fuel and ignited for generating hot combustion gases from which energy is extracted by turbine stages which power the compressor and fan.

One conventional turbofan engine commercially used in this country for many years includes a low temperature fan having a plurality of stall grooves disposed in the inner surface of the fan casing. The stall grooves improve stall margin of the air as it is compressed during operation.

The fan casing and its stall grooves are positioned radially close to the blade tips for minimizing the radial gap or clearance therebetween during operation. However, during certain transient operating conditions of the engine, differential expansion or contraction, or other radial movement, between the stator casing and the rotor blades may cause temporary rubbing of the blade tips against the casing. Blade tip rubbing generates abrasion and friction heat and subjects the blade tips and casing to locally high stress. Repeated or extensive tip rubbing may lead to premature cracking in the blade tips which require suitable repair or replacement of the blades.

Tip rubbing may be reduced or eliminated by increasing the nominal blade tip clearance, but this results in a corresponding decrease in engine efficiency.

Abrasive coatings may be applied to the blade tips for minimizing degradation thereof due to rubbing with the stator casing. However, the abrasive coatings themselves are subject to wear and may be prematurely damaged upon rubbing the intervening lands between the stall grooves. Furthermore, the use of abrasive tip coatings may adversely affect the mechanical properties of the blade material itself limiting the useful life thereof.

Abradable coatings may be added to the inside of the stator to minimize blade tip degradation during rubs. In stall groove designs, coatings soft enough to protect the blade tips are generally too soft to survive in an erosive environment, and wear away leaving large tip clearances which adversely affect performance and stall margin of the engine.

Fan or compressor blades are typically mounted to the perimeter of a rotor disk using conventional dovetails which permit the replacement of individual blades as desired. However, in a unitary or one-piece blisk the blades extend directly from their supporting disk and are not individually replaceable except by severing thereof from the disk.

In view of these various considerations, conventional stall grooves are typically limited to low temperature fan applications so that they may be formed in an elastomeric material for preventing damage to blade tips during rubs therebetween. However, advanced gas turbine engines being developed operate at relatively higher temperature in fans and compressors which prevents the use of elastomeric material for stall grooves. The stall grooves must instead be formed in a high-strength metal which will significantly abrade blade tips during tip rubbing severely limiting the practical use thereof.

Accordingly, it is desired to provide a rub resistant compressor stage including stall grooves therein.

BRIEF SUMMARY OF THE INVENTION

A compressor casing is configured to surround blade tips in a compressor stage. The casing includes stall grooves with adjoining lands defining respective local gaps with the blade tips. At least one of the lands is offset to locally increase a corresponding one of the gaps larger than the nominal gap for the casing to reduce tip rubbing thereat.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
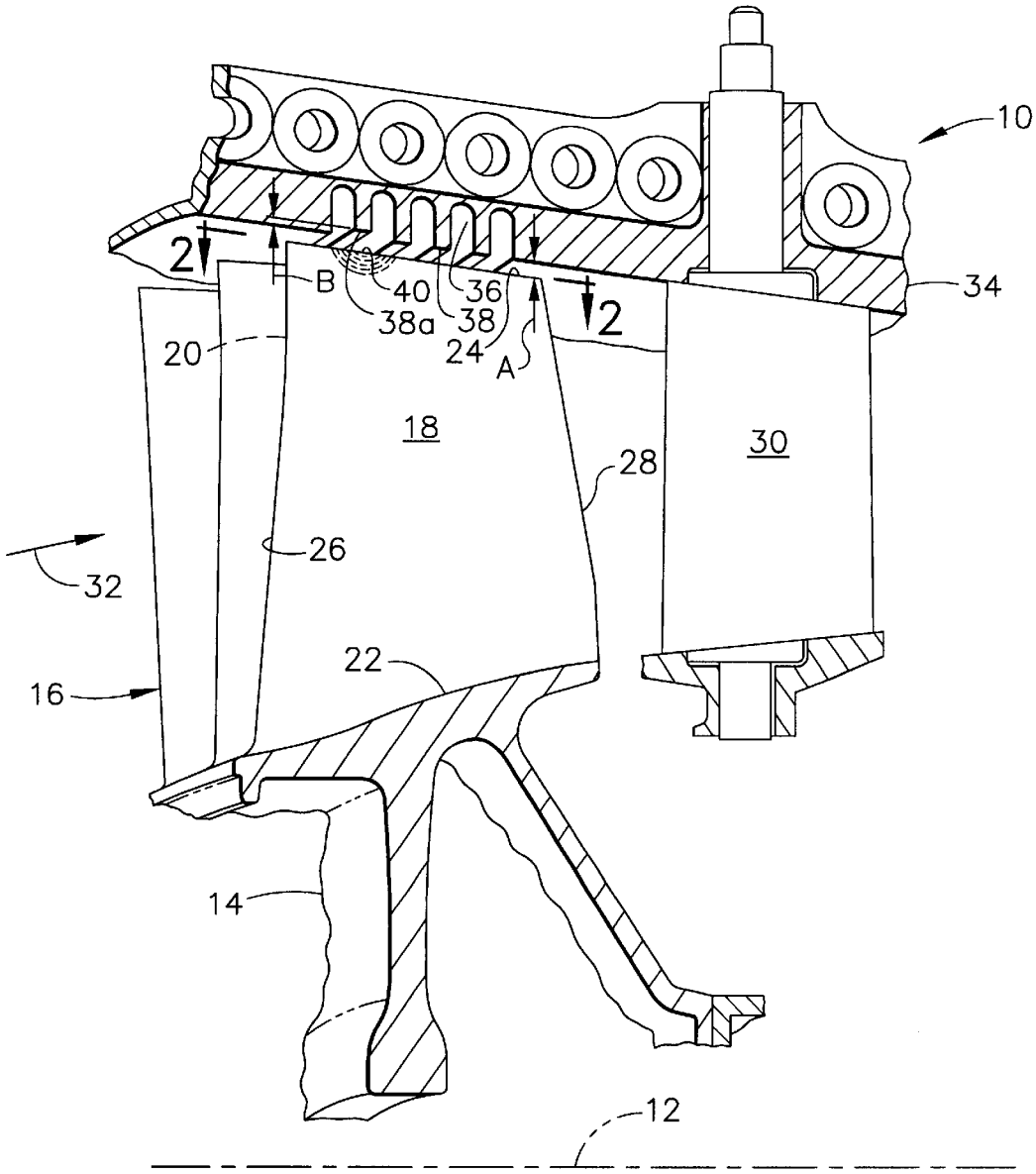
FIG. 1 is a side elevational view of a portion of a gas turbine engine compressor stage having a row of disk mounted blades adjoining a stator casing configured in accordance with an exemplary embodiment of the present invention.

Illustrated in FIG. 1 is an exemplary compressor stage 10 of a turbofan gas turbine engine in accordance with an exemplary embodiment of the present invention. The compressor stage is axisymmetrical about an axial centerline axis 12 and includes an annular rotor disk 14 which is powered by a turbine rotor (not shown).

A plurality of rotor airfoils or blades 16 are circumferentially spaced apart around the perimeter of the disk 14 and extend radially outwardly therefrom in a unitary, one-piece blisk construction. In an alternate embodiment, the blade 16 may have conventional dovetails (not shown) removably mounted in corresponding dovetail slots formed in the perimeter of the disk in a conventional mariner.

Figure 2:
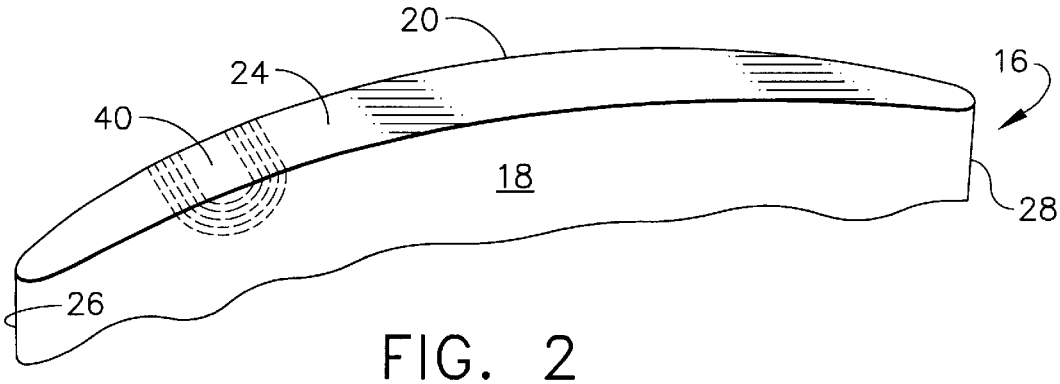
FIG. 2 is an isometric view of a tip of an exemplary one of the blades illustrated in FIG. 1 and taken along line 2—2.

Each blade 16 includes a generally concave, pressure side or sidewall 18, see also FIG. 2, and a circumferentially opposite, generally convex suction side or sidewall 20. The two sides extend radially from a root 22 to a radially outer tip 24, and axially between a leading edge 26 and a trailing edge 28. The blade 16 is typically solid for fan or compressor applications, and has a plain, generally flat tip.

The rotor defined by the blades and disk cooperates with a downstream row of stator vanes 30 which may be fixed or pivotable for controlling their performance. During operation, ambient air 32 flows axially downstream between the blades 16 for pressurization or compression thereof, and flows in turn through the stator vanes 30 through additional compressor or fan stages as desired for further increasing air pressure.

The compressor stage illustrated in FIG. 1 also includes a circumferentially arcuate casing 34 which may be formed in two semi-circular arcuate halves bolted together to form a complete ring. The casing 34 surrounds the blade tips and is spaced radially outwardly therefrom to define a nominal or primary tip clearance or gap A therebetween. The stator vanes 30 are suitably fixedly or pivotally mounted to the stator casing.

The compressor casing 34 includes a plurality of circumferentially extending stall grooves 36 disposed in the radially inner surface of the casing and defined by corresponding ribs therebetween. The grooves 36 extend the full circumference of the casing 34, and are spaced axially apart by intervening or adjoining lands 38 to define respective local gaps with the blade tips 24.

In a conventional configuration, the lands 38 would be flat with sharp corners and spaced from the blade tip to effect the same nominal gap A at each land as at the casing inner surface bordering the stall grooves. In this way, the blade clearance may be controlled, and aerodynamic performance of the stall grooves may be maximized. However, conventional stall grooves are formed in an elastomeric material which prevents damage to the blade tips during tip rubbing.

In accordance with one feature of the present invention, the casing 34 in which the stall grooves 36 are formed is not elastomeric, but instead is a suitable metal for the increased temperature requirements of the high performance compressor of which it is a part. Since the ribs defining the stall grooves and their lands 38 are now metal, an improved stall groove design is required for limiting damage from transient tip rubs during operation.

Accordingly, in accordance with another feature of the present invention, at least one of the lands, designated 38*a*, as shown in FIG. 1 is radially offset relative to the blade tip to locally increase a corresponding one of the local or land gaps larger than the nominal gap A. By selectively offsetting individual lands, blade tip rubbing is confined only to the casing inner surface and the non-offset lands for reducing or preventing tip rubbing solely at the offset land 38*a* during transient operation of the compressor or fan.

It is not desirable to offset all of the stall groove lands because this would adversely affect the intended performance thereof. Selective land offset permits maximum performance of the stall grooves, while also reducing the extent of tip rubbing for a combined benefit therefrom.

More specifically, each of the rotor blades illustrated generally in FIG. 1, and more specifically in FIG. 2, includes a fundamental natural vibratory frequency and corresponding mode shape, and higher order harmonics thereof. Each mode shape includes nodal lines of zero displacement, with increasing displacement therebetween with corresponding vibratory stress. For example, the fundamental vibratory mode of a rotor blade is simple flexure bending of the blade from its root 22. The higher order harmonic modes of vibration result in correspondingly more complex mode shapes and correspondingly higher vibratory frequencies.

It has been discovered that the selective offset of stall groove lands corresponding with higher order vibratory response of the blades may be used to limit stress during tip rubbing, and correspondingly increase the useful life of the blade. In particular, FIG. 2 illustrates a portion of an exemplary higher order vibratory mode shape having a local maximum vibratory stress at a portion of the blade tip 24 which defines a corresponding target 40. Conventional vibratory analysis may be used to identify the specific location of the locally high stress target 40 at the blade tip, which typically occurs in third, fourth, or higher modes of vibration typically referred to as stripe modes.

As shown in FIG. 1, the offset land 38*a* is selected for being axially aligned with the corresponding target 40 at the blade tip. In this way, rubbing of the blade tip against the casing and the non-offset lands 38 is limited to relatively low stress regions at the blade tip, whereas the high stress region at the target 40 is protected by the offset land 38*a* at which little or no rubbing occurs.

In the exemplary embodiment illustrated in FIG. 1, the target 40 is disposed adjacent the blade leading edge 26 at the blade tip, and the offset land 38*a* is disposed radially thereabove in axial alignment therewith.

Figure 3:
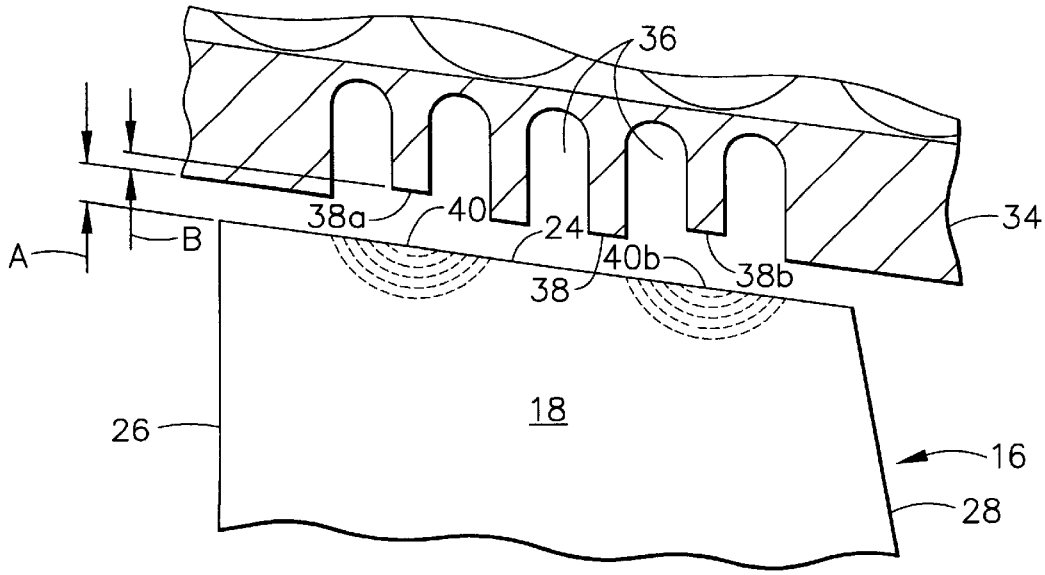
FIG. 3 is an enlarged, side elevational view of one of the blade tips and adjoining stator casing as illustrated in FIG. 1 in accordance with another embodiment of the present invention.

FIG. 3 illustrates an alternate embodiment of the casing 34 which also includes the offset land 38*a* adjacent the blade leading edge 26 radially atop the corresponding target 40. However, FIG. 3 also illustrates a second offset land 38*b* which locally increases the gap above the blade tip 24 for being axially aligned radially above a second target 40*b* of local maximum vibratory stress adjacent the blade trailing edge 28.

FIG. 3 illustrates a common vibratory mode in which two local targets 40,40*b* of high vibratory stress are located along the blade tip between the leading and trailing edges. The first target 40 is generally at about 25% of the chord length, with the second target 40*b* being at about 75% of the chord length. The two offset lands 38*a,b* are therefore disposed at the opposite axial ends of the stall grooves 36 corresponding with the two targets 40,40*b* at opposite axial ends of the blade tips.

In this way, only those specific lands corresponding with the vibratory targets are offset radially therefrom for preventing or substantially reducing rubbing contact therebetween during transient operation. The stall grooves otherwise operate conventionally and may be configured for maximizing performance thereof notwithstanding the locally offset portions thereof.

More specifically, the blade tips 24 illustrated in FIGS. 1–3 are preferably flat and straight in axial section and axial projection, with the offset land 38*a,b* being preferably recessed in the casing by a suitable recess B. The recess B is relative to the inner surface of the casing and correspondingly increases the nominal gap A by the recess amount B at the individual offset lands 38*a,b*.

As shown in FIG. 3, the offset lands 38*a,b* are preferably flat or straight in axial section and have sharp upstream and downstream corners. In this way, all of the lands 38 may be flat with sharp corners for maximizing aerodynamic performance of the stall grooves during operation. And, in the event of transient blade rubbing with the casing 34, only those non-offset lands 38 will rub the blade tips at relatively low regions of stress, with the offset lands 38*a,b* being spaced from the selected high-stress regions of the blade tips at the targets.

Figure 4:
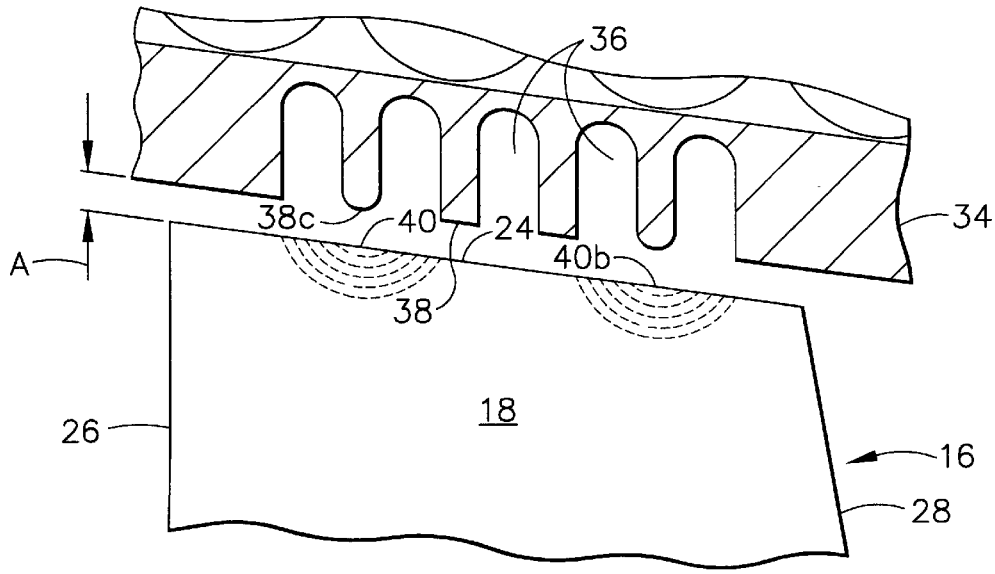
FIG. 4 is an enlarged, side elevational view of one of the blade tips and adjoining stator casing as illustrated in FIG. 1 in accordance with another embodiment of the present invention.

FIG. 4 illustrates an alternate embodiment of the present invention wherein the offset lands, designated 38*c*, are arcuate in axial section and preferably have a constant radius such as being semi-circular at the radially inner ends of the dividing ribs of the stall grooves. In this way, the offset lands may be coextensive at their apexes with the adjoining lands, and offset in part as they curve radially outwardly.

Accordingly, the nominal blade tip gap or clearance A is maintained at each of the lands, yet the arcuate offset lands will substantially reduce stress with the blade tips during a transient rub. The non-offset lands 38 maintain their sharp square-corners for enhancing aerodynamic performance, with the offset lands having radiused corners for reducing stress in compromise with maximum aerodynamic efficiency thereof.

Figure 5:
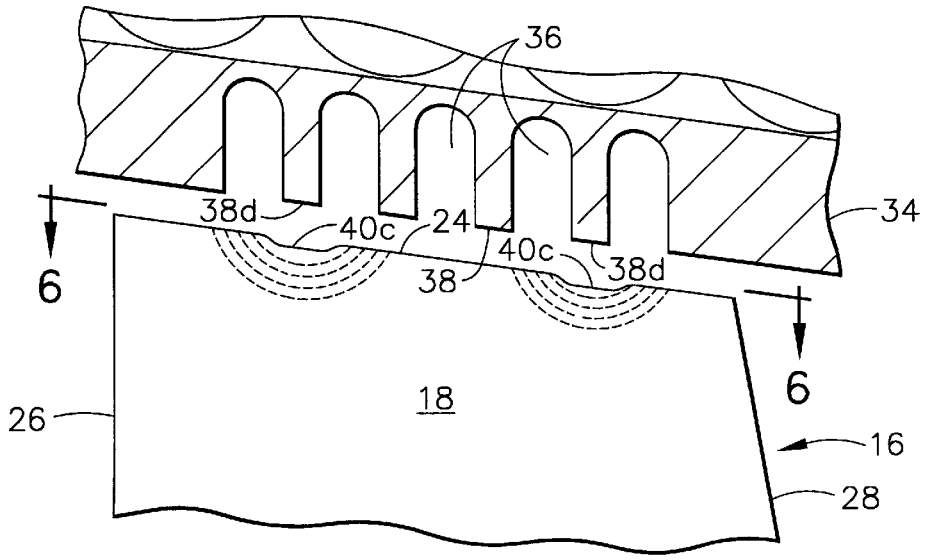
FIG. 5 is an enlarged, side elevational view of one of the blade tips and adjoining stator casing as illustrated in FIG. 1 in accordance with another embodiment of the present invention.
Figure 6:
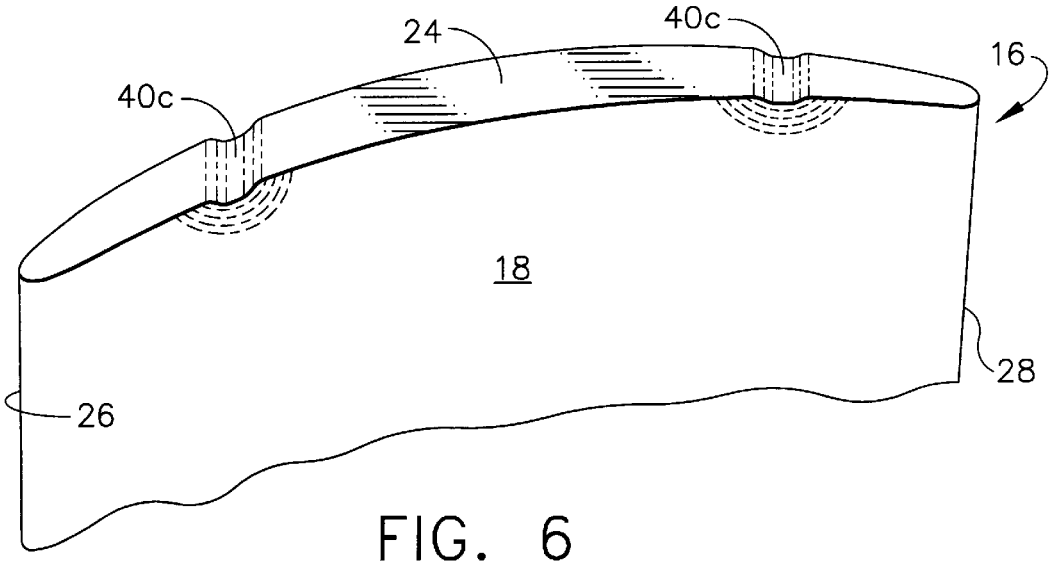
FIG. 6 is an isometric view of the blade tip illustrated in FIG. 5 and taken along line 6—6.

Illustrated in FIGS. 5 and 6 is yet another embodiment of the present invention wherein the offset lands, designated 38*d*, are coextensive with the inner surface of the casing 34 and the adjoining non-offset lands 38. Correspondingly, the otherwise flat blade tips 24 include respective targets, designated 40*c*, which are radially recessed inwardly into the blade tips at the desired locations of high vibratory stress thereat. The targets 40*c* are preferably axially arcuate and extend the full width of each blade between the pressure and suction sides.

The recessed targets 40*c* cooperate with the corresponding offset lands 38*d* so that during blade rubbing with the casing 34, the offset lands 38*d* do not contact or rub with the recessed targets 40*c*. The depth of the recessed targets is limited to prevent rubbing with the corresponding lands while minimizing the local clearance therebetween for minimizing leakage of the compressed air over the blade tips.

In the various embodiment disclosed above, clearances between blade tips and the stator casing may be increased locally to prevent rubbing at critical locations on the blade tip. Since the increased clearances are local, their affect on aerodynamic performance will be minimal. The nominal blade tip clearance A may remain relatively small, and the configuration of the stall grooves 36 remains basically unchanged for maximizing performance thereof, while introducing relatively small local increase in clearance at selected lands. Blade tip rubbing at the offset lands is either eliminated or reduced, with corresponding reductions in stress concentration and stress during tip rubbing with the blades.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A compressor stage comprising:

a rotor disk;

a plurality of circumferentially spaced apart blades extending radially outwardly from said disk, and each blade including circumferentially opposite pressure and suction sides extending radially from root to tip and axially between leading and trailing edges;

an arcuate casing surrounding said blade tips and spaced radially outwardly therefrom to define a nominal tip gap therebetween;

a plurality of circumferentially extending stall grooves disposed in an inner surface of said casing and facing said blade tips, and spaced axially apart by adjoining lands defining respective local gaps with said blade tips; and at least one of said lands is offset to locally increase a corresponding one of said local gaps larger than said nominal gap for reducing tip rubbing at said offset land as said tips rub said casing.

2. A stage according to claim 1 wherein:

each of said blades includes a natural vibratory frequency with a corresponding mode shape having a local maximum vibratory stress at a portion of said blade tip defining a target; and said offset land is axially aligned with said target.

3. A stage according to claim 2 wherein target is disposed adjacent said blade leading edge, and said offset land is disposed radially thereabove.

4. A stage according to claim 2 wherein said target is disposed adjacent said blade trailing edge, and said offset land is disposed radially thereabove.

5. A stage according to claim 2 wherein:

said target is disposed adjacent said blade leading edge, and said offset land (38*a*) is disposed radially thereabove; and a second target is disposed adjacent said blade trailing edge, and a second offset land is disposed radially thereabove.

6. A stage according to claim 2 wherein said blade tips are flat, and said offset land is recessed in said casing.

7. A stage according to claim 6 wherein said offset land is flat in axial section.

8. A stage according to claim 6 wherein said offset land is arcuate in axial section.

9. A stage according to claim 2 wherein said offset land is coextensive with said casing, and said target is recessed in said blade tip.

10. A stage according to claim 9 wherein said target is axially arcuate.

11. A compressor casing for surrounding a row of blades, comprising:

a plurality of circumferentially extending stall grooves disposed in an inner surface of said casing for facing tips of said blades, and spaced axially apart by adjoining lands to define respective local gaps with said blade tips; and at least one of said lands is recessed to offset said one land in said casing.

12. A casing according to claim 11 wherein said offset land is flat in axial section.

13. A casing according to claim 11 wherein said offset land is arcuate in axial section.

14. A compressor stage comprising:

a rotor disk;

a plurality of circumferentially spaced apart blades extending radially outwardly from said disk, and each blade including circumferentially opposite pressure and suction sides extending radially from root to tip and axially between leading and trailing edges;

an arcuate casing surrounding said blade tips and spaced radially outwardly therefrom to define a nominal tip gap therebetween;

a plurality of circumferentially extending stall grooves disposed in an inner surface of said casing and facing said blade tips, and spaced axially apart by adjoining lands defining respective local gaps with said blade tips;

at least one of said lands is offset to locally increase a corresponding one of said local gaps larger than said nominal gap for reducing tip rubbing at said offset land as said tips rub said casing; and wherein said blade tips are flat, and said offset land is recessed in said casing.

15. A stage according to claim 14 wherein said offset land is flat in axial section.

16. A stage according to claim 14 wherein said offset land is arcuate in axial section.

17. A stage according to claim 14 further comprising two of said offset lands disposed at opposite axial ends of said stall grooves.

* * * * *